US006249665B1

(12) United States Patent
Yuge et al.

(10) Patent No.: US 6,249,665 B1
(45) Date of Patent: Jun. 19, 2001

(54) IMAGE FORMING APPARATUS CLEANER WITH ROTATING PADDLE FOR CONVEYING TONER TO A COLLECTOR

(75) Inventors: Keiji Yuge, Yokohama; Yoshinori Sanmonji, Kawasaki, both of (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/501,599

(22) Filed: Feb. 10, 2000

(51) Int. Cl.[7] ..... G03G 21/00; G03G 15/20

(52) U.S. Cl. ..... 399/358; 399/123; 399/351

(58) Field of Search ..... 15/256.5, 256.51, 15/256.2; 399/123, 343, 345, 350, 351, 358, 359, 360; 430/125

(56) References Cited

U.S. PATENT DOCUMENTS

| | | | | |
|---|---|---|---|---|
| 4,364,660 | | 12/1982 | Oda | 355/15 |
| 4,501,620 | | 2/1985 | Oda | 134/6 |
| 4,819,031 | * | 4/1989 | Thayer et al. | 399/358 |
| 5,416,572 | * | 5/1995 | Kolb et al. | 399/358 |
| 5,519,470 | * | 5/1996 | Corrigan, Jr. | 399/358 |
| 5,597,419 | * | 1/1997 | Gerbasi et al. | 134/6 |
| 5,890,048 | * | 3/1999 | Hirota | 399/358 |

FOREIGN PATENT DOCUMENTS 63-23552 5/1988 (JP) .

* cited by examiner

*Primary Examiner*—Arthur T. Grimloy
*Assistant Examiner*—Hoang Ngo
(74) *Attorney, Agent, or Firm*—Foley & Lardner

(57) ABSTRACT

An image forming apparatus is disclosed with a cleaner assembly for removing toner remaining on the surface of the image bearing body that includes a rotating paddle for conveying toner to a collector. The image forming apparatus includes a developer for developing a static latent image on an image bearing body using toner, a transfer unit for transferring a developed image on a transfer member, a cleaner assembly in sliding contact with the surface of the image bearing body, a rotating paddle having a toner-conveying face, and a toner scraping sheet in contact with the rotating paddle conveying face. The tips of the rotating paddle may be angled to reduce friction and wear.

20 Claims, 4 Drawing Sheets

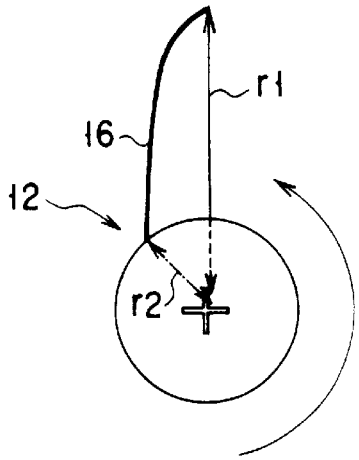
FIG. 3A
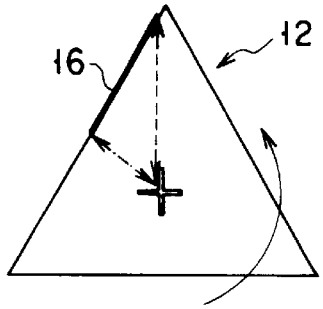
FIG. 3B
FIG. 4
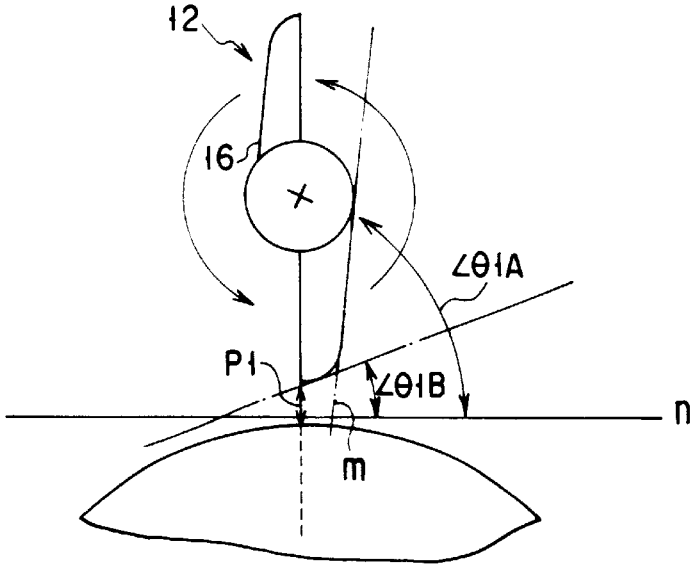
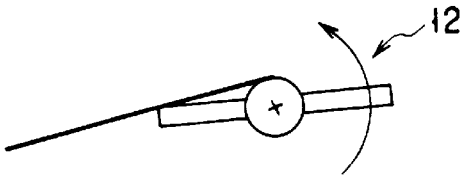
FIG. 5A
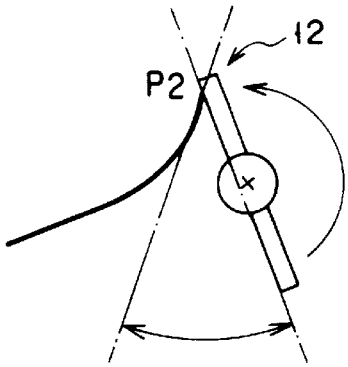
FIG. 5B

IMAGE FORMING APPARATUS CLEANER WITH ROTATING PADDLE FOR CONVEYING TONER TO A COLLECTOR

BACKGROUND OF THE INVENTION

The present invention relates to an image forming apparatus, and more particularly to improvement of a cleaner for removing toner remaining on the surface of an image bearing body after transfer of a toner image.

Conventionally, in an image forming apparatus such as an electronic photography copying machine, a cleaner having a cleaning blade has been used to remove developing agent not transferred but remaining on the surface of an image bearing body, as disclosed in Jpn. Pat. Appln. KOKOKU Publication No. 63-23552.

Further, there is well known an image forming apparatus which is provided with a magnet member for forcibly attracting waste toner remaining on the image bearing body scraped by a cleaning blade. As a method for removing toner from the roller-shaped magnet member, a method in which a scraper-like toner scraping member is disposed to be in contact with the magnet roller and a method in which a portion of a belt-like sheet member located near the image bearing body brought into contact with the magnet, the end portion of the sheet is separated from magnetic body so as to remove toner have been known.

The remaining toner kept on the surface of the image bearing body in the cleaner by the cleaning blade comes to have a higher packing density compared to ordinary toner if accumulated thereon. Therefore, if the packing density of the accumulated remaining toner increases extremely, a cleaning limit of the cleaning blade is exceeded so that a cleaning fault occurs. Alternatively, a blade edge is damaged by an increase of load so that the aging is accelerated. As a result, the cleaning limit value is lowered thereby leading to such cleaning fault.

Conventionally, to reduce this toner accumulating quantity, a paddle-like rotating body or roll-like magnet is provided to relax the toner pressure. However, because if such a member is provided, the toner scraping member comes into a contact with a rotating roller or paddle, flip sound or friction noise occurs or unnecessary vibration occurs.

Further, because the elastic sheet-like toner separating member vibrates in an enclosed space of the cleaner, gas in the cleaner is discharged out thereof thereby leading to dissipation of toner. Further, the scraping member or paddle or magnet is worn during a copy service life so that removal of toner becomes unequal. As a result, toner collection is partially made difficult so that the cleaning fault is generated.

BRIEF SUMMARY OF THE INVENTION

An object of the present invention is to provide an image forming apparatus capable of removing and collecting developing agent remaining on the surface of an image bearing body effectively without generating friction noise or vibration.

Another object of the present invention is to provide an image forming apparatus capable of removing and collecting developing agent remaining on the surface of the image bearing body effectively without dissipating in the apparatus.

To achieve the above object, according to an aspect of the present invention, there is provided an image forming apparatus comprising a developer for developing a static latent image on an image bearing body using developing agent, a transfer unit for transferring a developed developing agent image on a transfer member and a cleaner disposed so as to be in a sliding contact with the surface of the image bearing body for removing developing agent remaining on the image bearing body after the transferring, the cleaner including a cleaning member for removing developing agent remaining on the image bearing body from the image bearing body, a rotating paddle having a developing agent conveying face for conveying developing agent removed from the image bearing body by the cleaning member upward from a portion near the image bearing body while rotating, and a developing agent scraping member whose tip is in contact with the developing agent conveying face of the rotating paddle for scraping developing agent adhering to the rotating paddle, wherein assuming that an angle between a tangent line of the developing agent conveying face of the rotating paddle and a tangent line of the image bearing body is $\angle\theta 1$ at a position in which the tip of the rotating paddle approaches the image bearing body most and the $\angle\theta 1$ in the center of the rotating paddle is $\angle\theta 1A$ while the $\angle\theta 1$ at the tip of the rotating paddle is $\angle\theta 1B$, the rotating paddle has a curved shape so as to satisfy an inequality of $\angle\theta 1A > \angle\theta 1B$.

Further, according to another aspect of the present invention, there is provided an image forming apparatus comprising a developer for developing a static latent image on an image bearing body using developing agent, a transfer unit for transferring a developed developing agent image on a transfer member and a cleaner disposed so as to be in a sliding contact with the surface of the image bearing body for removing developing agent remaining on the image bearing body after the transferring, the cleaner including a cleaning member for removing developing agent remaining on the image bearing body from the image bearing body, a rotating paddle having a developing agent conveying face for conveying developing agent removed from the image bearing body by the cleaning member upward from a portion near the image bearing body while rotating, a developing agent scraping member whose tip is in contact with the developing agent conveying face of the rotating paddle for scraping developing agent adhering to the rotating paddle and a partition wall disposed at a position between the developing agent scraping member and the cleaning member, corresponding to a region outside of a region in which an image is formed on the image bearing body in a longitudinal direction of the cleaning member.

Further, according to still another aspect of the present invention, there is provided an image forming apparatus comprising a developer for developing a static latent image on an image bearing body using developing agent, a transfer unit for transferring a developed developing agent image on a transfer member and a cleaner disposed so as to be in a sliding contact with the surface of the image bearing body for removing developing agent remaining on the image bearing body after the transferring, the cleaner including a cleaning member for removing developing agent remaining on the image bearing body from the image bearing body, a rotating paddle having a developing agent conveying face for conveying developing agent removed from the image bearing body by the cleaning member upward from a portion near the image bearing body while rotating, a developing agent scraping member whose tip is in contact with the developing agent conveying face of the rotating paddle for scraping developing agent adhering to the rotating paddle and a partition wall disposed at a position between the developing agent scraping member and the cleaning member, corresponding to a region outside of a region in which an image is formed on the image bearing body in a longitudinal direction of the cleaning member, wherein assuming that an angle between a tangent line of the developing agent conveying face of the rotating paddle and a tangent line of the image bearing body is $\angle\theta 1$ at a position in which the tip of the rotating paddle approaches the image bearing body most and the $\angle\theta 1$ in the center of the rotating paddle is $\angle\theta 1A$ while the $\angle\theta 1$ at the tip of the rotating paddle is $\angle\theta 1B$, the rotating paddle has a curved shape so as to satisfy an inequality of $\angle\theta 1A > \angle\theta 1B$.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

FIGS. 3A to 6B are diagrams for explaining a cleaner according to a first embodiment of the present invention;

DETAILED DESCRIPTION OF THE INVENTION

Hereinafter, preferred embodiments of the present invention will be described with reference to the accompanying drawings.

Figure 1:
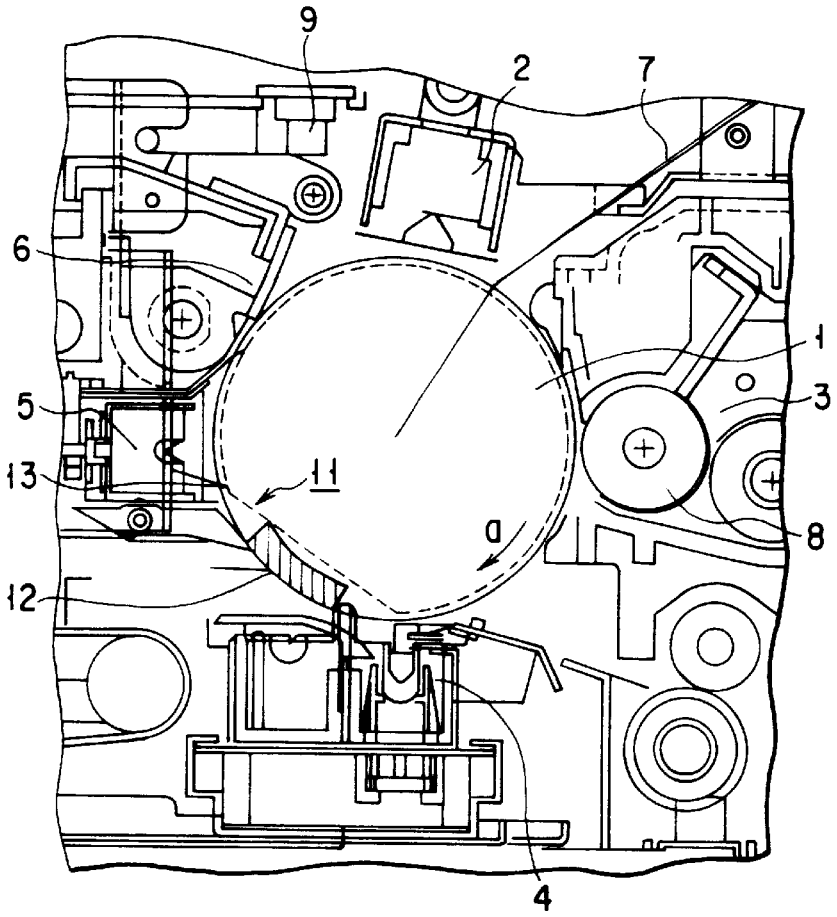
FIG. 1 is a diagram showing a schematic structure of an electronic photography process unit of an image forming apparatus according to an embodiment of the present invention.

FIG. 1 is a diagram showing a schematic structure of an electrophotography process unit of an image forming apparatus according to an embodiment of the present invention.

Referring to FIG. 1, a photosensitive drum 1 (hereinafter referred to as drum) as an image bearing body is basically comprised of a conductive supporting body, a photoconductive layer and an insulating layer as well known. Along a rotation direction indicated by an arrow "$\alpha$" on the circumference of this drum 1, a charging unit 2 for charging the surface of the drum 1 uniformly, a developing unit 3 for developing a static latent image formed on the surface of the drum 1 using a two-component developing agent consisting of a toner and a carrier, a transfer unit 4 for transferring a visible image developed on the drum 1 onto a paper, a pre-cleaning destaticizer 5 as an auxiliary cleaning function for destaticizing toner remaining on the surface of the drum 1 after transfer and a cleaner 6 for removing the remaining toner.

Figure 2:
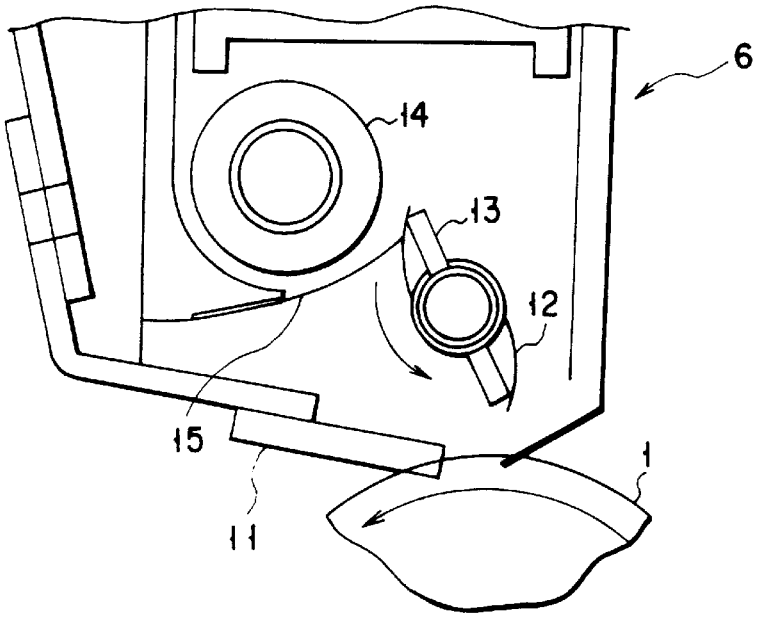
FIG. 2 is a diagram showing a structure of a cleaner according to the present invention.

The cleaner 6 has a structure shown in FIG. 2. That is, the cleaner 6 disposed above the drum 1 comprises a cleaning blade 11 whose tip presses the drum 1, a rotating paddle 12 disposed above this cleaning blade 11, a magnet 13 attached to the rotating paddle 12, a waste toner carrying auger 14 disposed adjacent to the rotating paddle 12 and a toner scraping sheet 15 disposed such that a tip thereof is in contact with the rotating paddle 12.

An operation of the image forming apparatus having such a structure will be described.

First, the surface of the drum 1 is charged uniformly to an arbitrary charging potential by the charging unit 2. Subsequently, laser beam is transmitted by a laser oscillator (not shown) based on image information, modulated according to an input signal to a modulator (not shown), and scanned by a rotating polygon mirror (not shown) so that laser beam 7 is irradiated onto the surface of the drum 1 through a focusing lens (not shown). A surface potential of the irradiated portion of the drum 1 is lowered to about remaining potential due to light attenuation so that static latent image is formed.

On the other hand, a bias voltage of a constant level is applied to a developing roller 8 in a developing apparatus 3. If the drum 1 carrying the static latent image comes into contact with the developing roller 8, toner attaching to the surface of the developing roller 8 by magnetic force attracted to the laser irradiated portion (remaining potential portion) on the drum 1 due to a potential difference between the drum 1 and the developing roller 8. As a result, the static latent image on the drum 1 is visualized.

Subsequently, toner image on the drum 1 is transferred to a paper (not shown) carried between the drum 1 and the transfer unit 4 and the toner image ransferred on the paper is subject to fixing rocessing by a fixing unit (not shown).

The toner remaining on the surface of the drum 1 is AC-discharged by the pre-cleaning discharger 5 so that it is removed from the drum 1 by the cleaner 6. After the cleaning, the static latent image on the drum 1 is optically discharged by an optical discharger 9 and after that, it is recharged by the charging unit 2, and then the processing proceeds to next image forming step.

Removal of the toner from the drum 1 by the cleaner 6 is carried out in the following manner. That is, the remaining toner on the surface of the drum 1 is removed from the surface of the drum 1 by the cleaning blade 11 which presses the surface of the drum 1. The toner removed from the surface of the drum 1 is scraped by the rotating paddle 12 and carried to the waste toner carrying auger 14, so that it is collected by the waste toner carrying auger 14. Thus, the toner removed from the surface of the drum 1 is prevented from being deposited on the surface of the drum 1 again by its own weight.

At that time, the toner adhering to the rotating paddle 12 is scraped by the toner scraping sheet 15 and collected by the waste toner carrying auger 14. If magnetic toner is used, toner removed by the magnet 13 mounted to the rotating paddle 12 from the surface of the drum 1 by the cleaning blade 11 is attracted by the rotating paddle 12 and carried to the waste toner carrying auger 14.

The present invention has the following two embodiments in improvement of the structure of the cleaner in the image forming apparatus described above.

First, the cleaner according to a first embodiment will be described with reference to FIGS. 3–6.

The cleaner according to the first embodiment of the present invention has a feature that a radius R of a curve at the tip surface of the rotating paddle 12 is decreased.

In the cleaner shown in FIG. 2, the rotating paddle 12 has two toner conveying faces (a toner scraping portion extending from a minimum radius portion r2 to a maximum radius portion r1 in FIG. 3A). If such a rotating paddle rotates a single turn, it scrapes the remaining toner in the vicinity of the image bearing body twice. At the same time, a tip of the toner scraping member 15 (Mylar 100-$\mu$m sheet in case of this embodiment) operates to scrape toner from the rotating paddle 12 twice during a single rotation of the rotating paddle, such that it slides in two reciprocations between the tip of the paddle and a shaft portion having no paddle.

Meanwhile, as shown in FIG. 3A, it is permissible to provide the rotating paddle 12 with a single toner conveying face 16.

In FIG. 4, assume that at a point P where the tip of the rotating paddle 12 approaches the image bearing body 1 most, an angle formed between a tangent line m of the waste toner conveying face of the rotating paddle 12 and a tangent line n of the image bearing body is $\angle\theta 1$. The $\angle\theta 1$ is an angle which affects toner conveying performance. If a distance between the tip of the rotating paddle 12 and the image bearing body 1 is the same, the smaller this angle, the lower the conveying performance of the waste toner is.

Because the toner scraping member 15 is provided to scrape toner on the rotating paddle 12, a tip thereof makes into contact with a portion near a center of the paddle shaft so as to scrape toner. Then, it is so constructed that the tip of the toner scraping member 15 keeps in contact with the rotating paddle 12 until it reaches the tip of the rotating paddle 12.

Assuming that a contact angle between the tip of the toner scraping member 15 and the toner conveying face 16 of the rotating paddle 12 is $\angle\theta 2$, if the $\angle\theta 1$ is larger than 90°, there is a possibility that the toner scraping member 15 may be broken due to a contact with the rotating paddle 12. Therefore, the angle $\angle\theta 2$ is set to be always less than 90° regardless of the rotation of the rotating paddle 12.

The $\angle\theta 2$ is an angle which affects friction resistance between the tip of the toner scraping member 15 and rotating paddle 12. If the sliding width of the toner scraping member 15 is the same, if the $\angle\theta 2$ is decreased, the friction resistance lowers.

A case in which the rotating paddle 12 is linear and a case in which the rotating paddle is triangle column (shown in FIG. 3B) are compared. Both the angles $\angle\theta 1$, $\angle\theta 2$ are smaller in the case of the triangle column than the case in which it is linear so that friction resistance between the toner scraping member 15 and the rotating paddle 12 is lowered. However, the toner conveying performance is also lowered. If the angle $\angle\theta 1$ of the toner conveying face is increased like the linear rotating paddle, the toner conveying performance is improved. However, because the angle $\angle\theta 2$ also increases, friction resistance is enlarged. In this case, the friction resistance becomes the highest when the tip of the toner scraping member 15 reaches the tip of the rotating paddle 12 after sliding (point P2 shown in FIG. 5B).

In the cleaner of this embodiment, the angle $\angle\theta 1$ is set to below 90° and the angle $\angle\theta 2$ is set to less than 90°. The rotating paddle 12 has a curved shape extending from a center of its axis toward the tip thereof provided on a part or entire region of the back with respect to a rotation direction. As for this curved shape, the radius R of the curve is made smaller at the tip of the rotating paddle 12 so as to ensure waste toner conveying performance and low friction resistance between the members (between the rotating paddle 12 and scraping member 15) so that the angles $\angle\theta 1$ and $\angle\theta 2$ are set small.

Figure 6A:
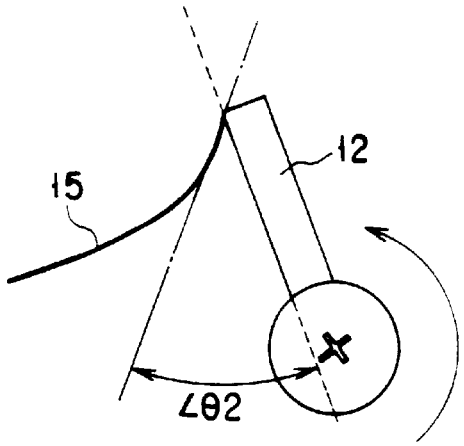
Figure 6B:
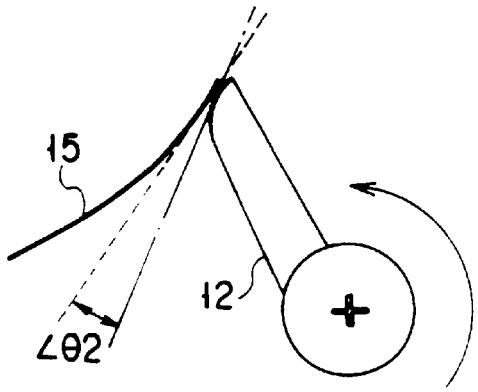

That is, the angle $\angle\theta 2$ of the linear rotating paddle shown in FIG. 6A is smaller than the angle $\angle\theta 2$ of the rotating paddle whose tip is curved as shown in FIG. 6B.

Therefore, the toner conveying face other than the tip of the rotating paddle 12 is set to near 90° to secure the waste toner conveying performance. Assuming that the angle $\angle\theta 1$ in the center of the rotating paddle 12 is $\angle\theta 1A$ and the angle $\angle\theta 1$ at the tip of the rotating paddle is $\angle\theta 1B$, the feature of the cleaner of this embodiment is that a condition of $\angle\theta \leqq 90°$, $\angle\theta 2 < 90°$ and $\angle\theta 1A > \angle\theta 1B$ is satisfied while the rotating paddle has a curved shape that the angle $\angle\theta 1$ gradually decreases toward the tip thereof.

According to the first embodiment of the present invention, because the rotating paddle 12 has the curved shape that the angle $\angle\theta 1$ decreases gradually toward the tip thereof or the angle $\angle\theta 1B$ in the center of the rotating paddle 12 is set smaller than the angle $\angle\theta 1A$ at the tip of the rotating paddle 12, the friction resistance of the toner scraping member 15 against the rotating paddle 12 can be decreased.

Thus, an occurrence of contact noise, friction noise and unnecessary vibration due to contact between the rotating paddle 12 and the toner scraping member 15 can be effectively prevented and further, the service lives of both the rotating paddle 12 and toner scraping member 15 can be prolonged.

In a cleaner shown in FIG. 2, a magnet 13 is attached to the rotating paddle 12. Thus, an operation of the magnet 13 will be described below.

If magnetic toner is used in the image forming apparatus in which the cleaner exists above the image bearing body, it is desirable to affix the magnet 13 onto the rotating paddle 12 so as to effectively remove waste toner deposit on the image bearing body 1 by magnetic force.

By affixing the magnet 13, which is so small that it does not exceed the maximum diameter r2 of the rotating paddle 12, on the back of the toner conveying face of the rotating paddle 12, it can be so constructed that the toner scraping member 15 never comes into contact with the magnet 13. In the cleaner shown in FIG. 2, magnetic toner adhering to the surface of the rotating paddle 12 by magnetic force is removed by the toner scraping member 15 by friction of a low resistance.

As described above, by attaching the magnet 13 to the rotating paddle 12, waste magnetic toner on the image bearing body 1 can be collected effectively by magnetic force.

Further, by attaching the magnet 13 to a region inside of the paddle outer circumference on the back of the toner conveying face of the rotating paddle 12, it is possible to prevent a friction between the magnet 13 having a high friction resistance or magnetic toner adhering directly to the magnet and the toner scraping member 15.

Next, a structure of the cleaner according to a second embodiment of the present invention will be described.

As described in the first embodiment, the toner scraping member 15 slides on the toner conveying face of the rotating paddle 12 by a rotation of the rotating paddle 12, and when the toner scraping member 15 returns from a position P2 shown in FIG. 5B to the minimum radius position of the rotating paddle 12, it acts to fan a gas in the cleaner 6. FIG.

7 shows a sliding region of the toner scraping member 15 against the toner conveying face of the rotating paddle 12.

Figure 7:
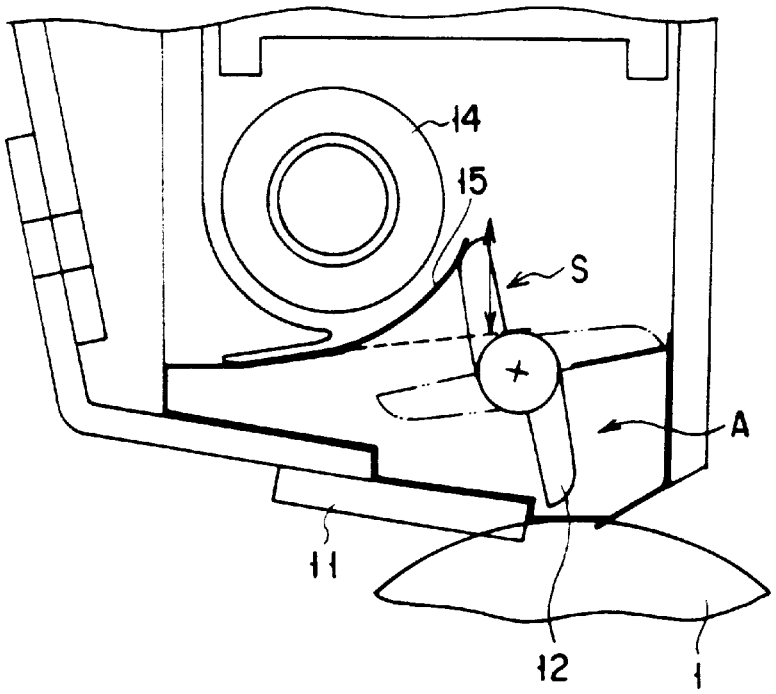
FIG. 7 is a diagram for explaining a problem of the cleaner according to a second embodiment of the present invention.
Figure 8:
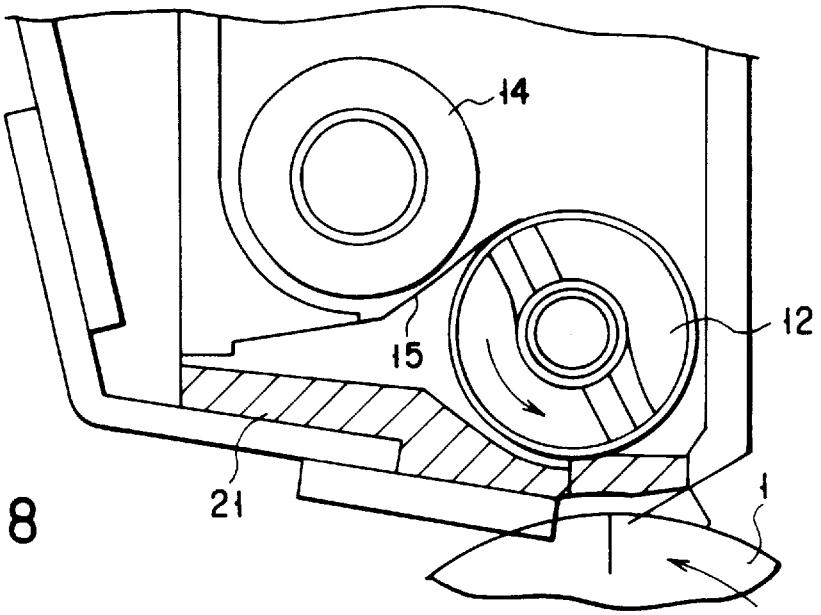
FIG. 8 is a diagram schematically showing a cleaner according to the second embodiment of the present invention.

Further, that operation changes a pressure in a region A (region surrounded by the cleaning blade 11, image bearing body 1, recovery sheet and rotating paddle 12) shown in FIG. 7 of the rotating paddle 12. Air containing toner powder in the cleaner 6 leaks from an end portion of the cleaning blade 11 because of air flow and change in a pressure caused by this fan operation so that toner is dissipated out of the cleaner 6.

According to this embodiment, a partition wall 21 is provided between the toner scraping member 15 and the cleaning blade 11. The partition wall 21 is provided at a position corresponding to the region outside of the region in which an image is formed on the image bearing body 1 along a longitudinal direction of the cleaning blade 11.

By providing the partition wall 21, a wind generated by the fan operation of the toner scraping member 15 by a rotation of the rotating paddle 12 can be stopped. Thus, dissipation of toner in the cleaner out of the cleaner can be prevented.

The toner scraping member 15 is disposed at a position in which it overlaps a phase in the longitudinal direction of the partition wall 21 and the rotating paddle 12 is disposed on the same phase as or inward of the toner scraping member 15.

Figure 9:
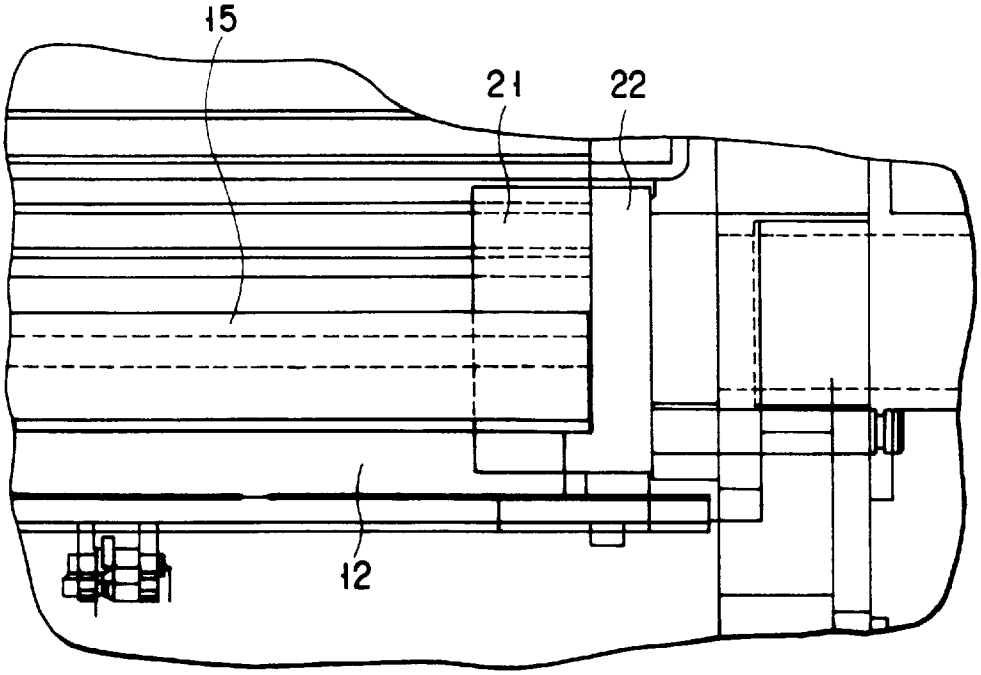
FIG. 9 is a diagram showing a modification of a cleaner according to the second embodiment of the present invention.

It is permissible to bond a sponge-like sealing member 22 to the partition wall 21 as shown in FIG. 9 to seal air to spout from an end in the longitudinal direction of the cleaning blade 11. The sealing member 22 is bonded to the partition wall 21 such that it is in contact with a supporting sheet metal of the cleaning blade 11, blade rubber and image bearing body 1.

As described above, according to the second embodiment of the present invention, by providing the partition wall 21 between the end portion in the longitudinal direction of the cleaning blade 11 and the toner scraping member 15, air flow generated by sliding motion of the toner scraping member 15 can be shielded by the partition wall 21, so that dissipation of the toner out of the cleaner an be prevented.

Particularly, by bonding the sponge like seal 22 to the partition wall 21, air in the apparatus compressed by the sliding motion of the toner scraping member 15 can be prevented from being blown from an end portion of the cleaning blade 11.

Additional advantages and modifications will readily occur to those skilled in the art. Therefore, the invention in its broader aspect is not limited to the specific details and representative embodiments shown and described herein. Accordingly, various modifications may be made without departing from the spirit or scope of the general inventive concept as defined by the appended claims and their equivalents.

What is claimed is:

1. An image forming apparatus comprising a developer for developing a static latent image on an image bearing body using developing agent, a transfer unit for transferring a developed developing agent image on a transfer member and a cleaner disposed so as to be in a sliding contact with the surface of the image bearing body for removing developing agent remaining on the image bearing body after the transferring, the cleaner including a cleaning member for removing developing agent remaining on the image bearing body from the image bearing body, a rotating paddle having a developing agent conveying face for conveying developing agent removed from the image bearing body by the cleaning member upward from a portion near the image bearing body while rotating, and a developing agent scraping member whose tip is in contact with the developing agent conveying face of the rotating paddle revolving for scraping developing agent attached to the rotating paddle, wherein assuming that an angle between a tangent line of the developing agent conveying face of the rotating paddle and a tangent line of the image bearing body is $\angle\theta 1$ at a position where a tip of the rotating paddle is closest to the image bearing body and the $\angle\theta 1$ in a center of the rotating paddle is $\angle\theta 1A$ while the $\angle\theta 1$ at the tip of the rotating paddle is $\angle\theta 1B$, the rotating paddle has a curved shape so as to satisfy an inequality of $\angle\theta 1A > \angle\theta 1B$.

2. An image forming apparatus according to claim 1, wherein a magnet having a size smaller than a diameter of the rotating paddle is attached to a face which is not in contact with the developing agent scraping member of the rotating paddle.

3. An image forming apparatus according to claim 1, wherein an inequality of $\angle\theta 1 \leqq 90°$ is satisfied.

4. An image forming apparatus according to claim 1, wherein assuming that a contact angle between the tip of the developing agent scraping member and the developing agent conveying face of the rotating paddle is $\angle\theta 12$, an entire face of the developing agent conveying face satisfies a condition of $\angle\theta 2 < 90°$.

5. An image forming apparatus according to claim 1, wherein the rotating paddle has plural developing agent conveying faces on a rotation shaft thereof.

6. An image forming apparatus according to claim 1, wherein the cleaning member is of plate or sheet.

7. An image forming apparatus according to claim 1, wherein the cleaner further comprises means for collecting developing agent conveyed from the rotating paddle.

8. An image forming apparatus comprising a developer for developing a static latent image on an image bearing body using developing agent, a transfer unit for transferring a developed developing agent image on a transfer member and a cleaner disposed so as to be in a sliding contact with the surface of the image bearing body for removing developing agent remaining on the image bearing body after the transferring, the cleaner including a cleaning member for removing developing agent remaining on the image bearing body from the image bearing body, a rotating paddle having a developing agent conveying face for conveying developing agent removed from the image bearing body by the cleaning member upward from a portion near the image bearing body while rotating, a developing agent scraping member of a sheet-like shape whose tip is in contact with the developing agent conveying face of the rotating paddle for scraping developing agent adhering to the rotating paddle and a partition wall for shielding air flow generated by a fan operation of the developing agent scraping member, thereby preventing dissipation of the developing agent out of the cleaner disposed between the developing agent scraping member and the cleaning member, corresponding to a region on both sides of a region in which an image is formed on the image bearing body in a longitudinal direction of the cleaning member.

9. An image forming apparatus according to claim 8, wherein the cleaning member and the developing agent scraping member are disposed at a position in which they overlap the partition wall in a longitudinal direction while the rotating paddle is disposed at a position so as to overlap the developing agent scraping member or at a position inward of the overlapping position, in which the rotating paddle does not overlap the developing agent scraping member.

10. An image forming apparatus according to claim 8, wherein a sponge-like sealing member is attached to the partition wall such that it is in contact with the cleaning member and the image bearing body.

11. An image forming apparatus according to claim 8, wherein the rotating paddle has plural developing agent conveying faces on a rotation shaft thereof.

12. An image forming apparatus according to claim 8, wherein the cleaning member is of plate or sheet.

13. An image forming apparatus according to claim 8, wherein the cleaner further comprises means for collecting developing agent conveyed from the rotating paddle.

14. An image forming apparatus comprising a developer for developing a static latent image on an image bearing body using developing agent, a transfer unit for transferring a developed developing agent image on a transfer member and a cleaner disposed so as to be in a sliding contact with a surface of the image bearing body for removing developing agent remaining on the image bearing body after the transferring, the cleaner including a cleaning member for removing developing agent remaining on the image bearing body from the image bearing body, a rotating paddle having a developing agent conveying face for conveying developing agent removed from the image bearing body by the cleaning member upward from a portion near the image bearing body while rotating, a developing agent scraping member whose tip is in contact with the developing agent conveying face of the rotating paddle for scraping developing agent adhering to the rotating paddle, and a partition wall disposed between the developing agent scraping member and the cleaning member, corresponding to a region outside of a region in which an image is formed on the image bearing body in a longitudinal direction of the cleaning member, wherein assuming that an angle between a tangent line of the developing agent conveying face of the rotating paddle and a tangent line of the image bearing body is $\angle\theta 1$ at a position where a tip of the rotating paddle is closest to the image bearing body and the $\angle\theta 1$ in a center of the rotating paddle is $\angle\theta 1A$ while the $\angle\theta 1$ at the tip of the rotating paddle is $\angle\theta 1B$, the rotating paddle has a curved shape so as to satisfy an inequality of $\angle\theta 1A > \angle\theta 1B$.

15. An image forming apparatus according to claim 14, wherein a magnet having a size smaller than a diameter of the rotating paddle is attached to a face which is not in contact with the developing agent scraping member of the rotating paddle.

16. An image forming apparatus according to claim 14, wherein an inequality of $\angle\theta 1 < 90°$ is satisfied.

17. An image forming apparatus according to claim 14, wherein assuming that a contact angle between the tip of the developing agent scraping member and the developing agent conveying face of the rotating paddle is $\angle\theta 2$, an entire face of the developing agent conveying face satisfies a condition of $\angle\theta 2 < 90°$.

18. An image forming apparatus according to claim 14, wherein the rotating paddle has plural developing agent conveying faces on a rotation shaft thereof.

19. An image forming apparatus according to claim 14, wherein the cleaning member is of plate or sheet.

20. An image forming apparatus according to claim 14, wherein the cleaner further comprises means for collecting developing agent conveyed from the rotating paddle. $\angle\theta 1B$, the rotating paddle has a curved shape so as to satisfy an inequality of $\angle\theta 1A > \angle\theta 1B$.

* * * * *